US006382493B1

(12) United States Patent
Cheng

(10) Patent No.: US 6,382,493 B1
(45) Date of Patent: May 7, 2002

(54) NAIL-PUSHING STRUCTURE OF NAILING GUN

(76) Inventor: Cheng Tsung Cheng, No. 110, Yi Hsin 2nd Road, Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/983,838

(22) Filed: Oct. 26, 2001

(51) Int. Cl.[7] ..... B25C 1/04
(52) U.S. Cl. ..... 227/120
(58) Field of Search ..... 227/120, 134, 227/119, 136, 109

(56) References Cited

U.S. PATENT DOCUMENTS 5,180,091 A * 1/1993 Ota ..... 227/120
5,297,713 A * 3/1994 Perra et al. ..... 227/120
5,322,189 A * 6/1994 Oda ..... 227/120
6,149,046 A * 11/2000 Ho et al. ..... 227/120
6,199,739 B1 * 3/2001 Mukoyama et al. ..... 227/120
6,296,167 B1 * 10/2001 Jen ..... 227/136

* cited by examiner

*Primary Examiner*—Scott A. Smith
(74) *Attorney, Agent, or Firm*—Rosenberg, Klein & Lee

(57) ABSTRACT

A nail-pushing structure of nailing gun, including a gun body having a head section. A frame body extends from the head section. A nail magazine loaded with a row of nails is mounted on the frame body. A nail-pushing structure is pivotally mounted in a receptacle of the frame body by a shaft. Flexible members are disposed on a large diameter section of the shaft for outward pushing a nail-pushing plate. Accordingly, the nail-pushing plate can truly push the row of nails in the nail magazine into the head section of the gun body along the nail channel for nailing operation.

5 Claims, 5 Drawing Sheets

NAIL-PUSHING STRUCTURE OF NAILING GUN

BACKGROUND OF THE INVENTION

The present invention is related to an improved nail-pushing structure of nailing gun, by which the nail magazine loaded with a row of nails can be easily installed into the gun body.

FIG. 5 shows a conventional nailing gun. The front end of the gun body 60 has a head section 61 in which a nail magazine 62 is inserted. The nail magazine 62 is formed with a nail channel (not shown) for receiving a row of nails 63 therein. Two springs 64 are disposed in the nail channel for pushing a nail-pushing plate 65 to push the row of nails 63 into the head section 61.

When the nails 63 in the nail magazine 62 is exhausted and a new row of nails 63 are to be loaded therein, a user must first exert a great force onto the nail-pushing plate 65 to press down the nail-pushing plate 65 and compress the two springs 64 thereunder. At this time, the user can load new row of nails 63 into the nail channel. In order to load the new row of nails 63 into the nail channel, the nail magazine 62 must have a length twice the length of the row of nails 63. It is inconvenient to fix the nail magazine 62.

The inventor of the present invention has provided an improved nailing gun structure having a frame body extending from the head section of the gun body. A nail magazine formed with several nail channels is disposed in the frame body. The nail channels have different patterns and are side by side arranged. The nail magazines can be transversely moved to aim any of the nail channels at the inlet of the head section of the gun body. The bottom of the nail channel is formed with a passage through which a nail-pushing plate upward pushes the various rows of nails. The nail-pushing plate is driven and reciprocally moved by a revolving pneumatic cylinder mounted on the frame body. The nail-pushing plate serves to push the rows of nails in different nail channels into the head section of the gun body.

The revolving pneumatic cylinder is able to conveniently move the nail-pushing plate to the bottom of the nail channel for a user to conveniently load new row of nails. However, the cost for the revolving pneumatic cylinder is so high that the price of the nailing gun will be too high for a consumer to purchase.

SUMMARY OF THE INVENTION

It is therefore a primary object of the present invention to provide an improved nail-pushing structure of nailing gun. When a user desires to install the nail magazine loaded with a new row of nails, by means of cranking a crank fitted on the small diameter section of the shaft, the flexible members disposed on the large diameter section are wound on the large diameter section. At this time, the nail-pushing plate is retracted into the nail-pushing plate seat along the nail channel. Under such circumstance, the nail magazine can be installed from one side of the frame body. It is easy to load the row of nails.

It is a further object of the present invention to provide the above nail-pushing structure of nailing gun in which the nailing-pushing plate is able to push T-shaped nails. When a U-shaped bent plate is additionally inserted in the nail-pushing plate, the nail-pushing plate also serves to push U-shaped nails. Therefore, the nail-pushing structure can be used to push different patterns of nails and the replacement of the nail-pushing plate is very easy.

The present invention can be best understood through the following description and accompanying drawings wherein:

DETAILED DESCRIPTION OF THE PREFERRED EMBODIMENTS

Figure 1:
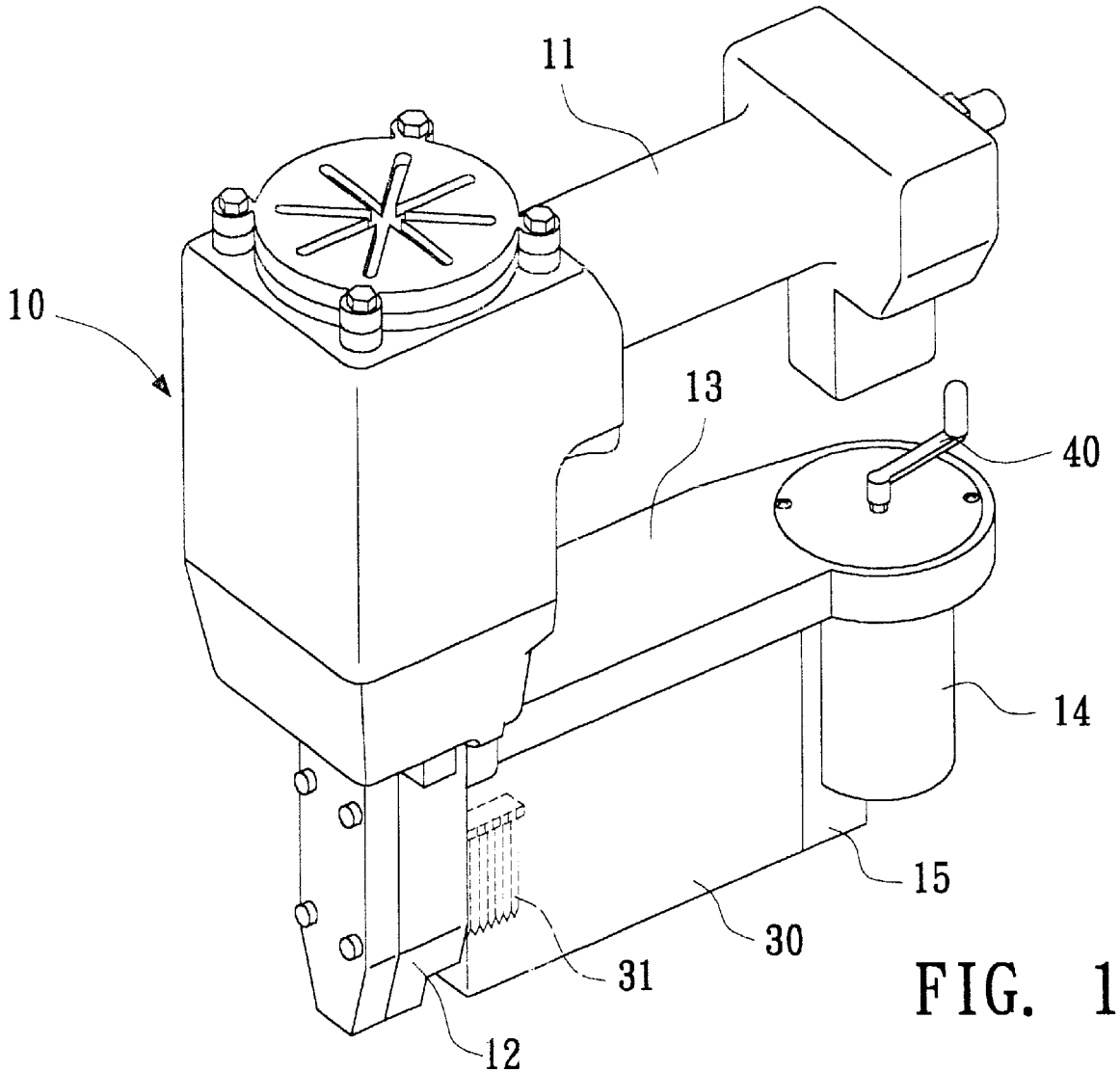
FIG. 1 is a perspective assembled view of the present invention.
Figure 2:
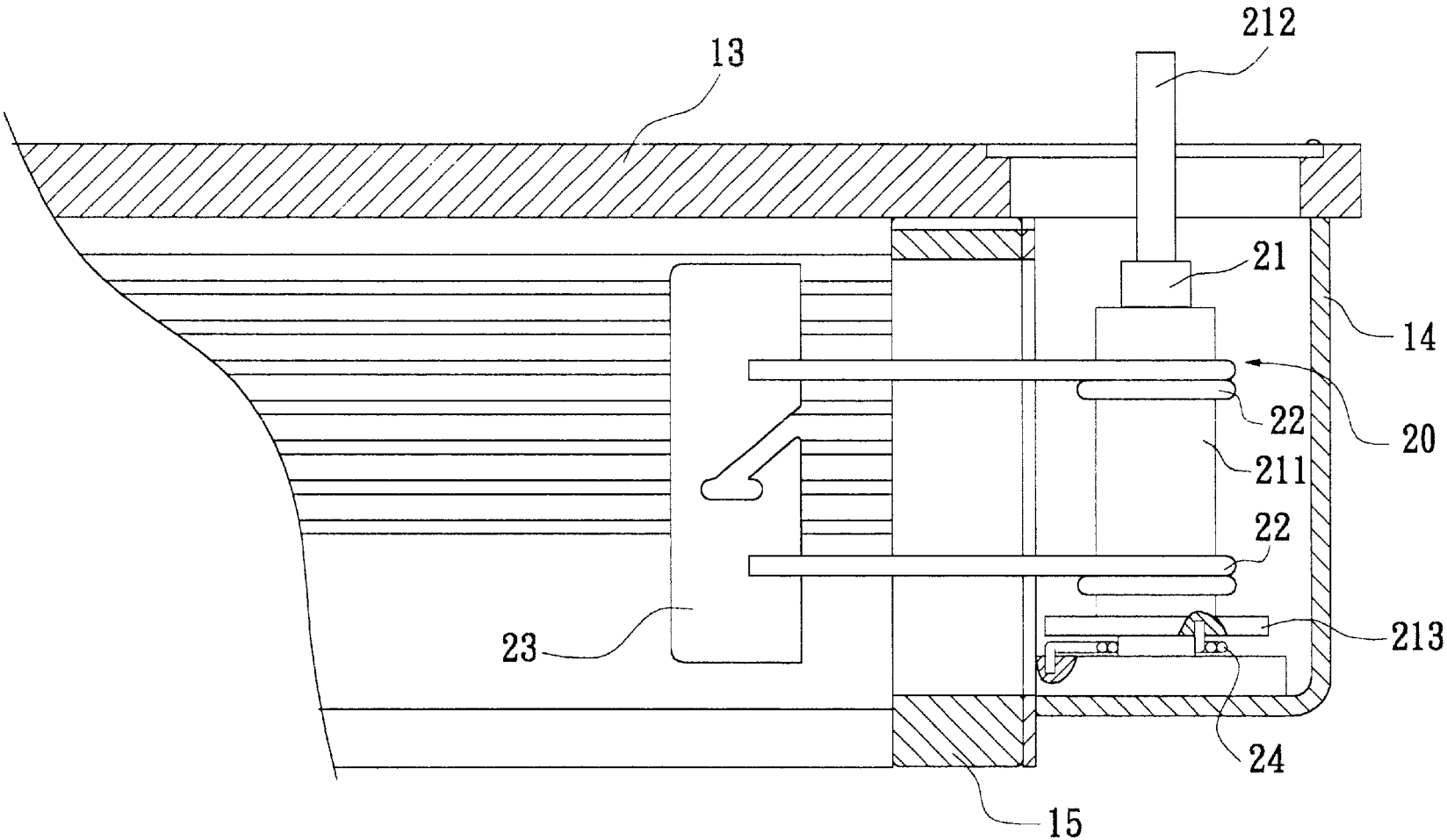
FIG. 2 is a sectional view of the nail-pushing structure of the present invention.
Figure 3:
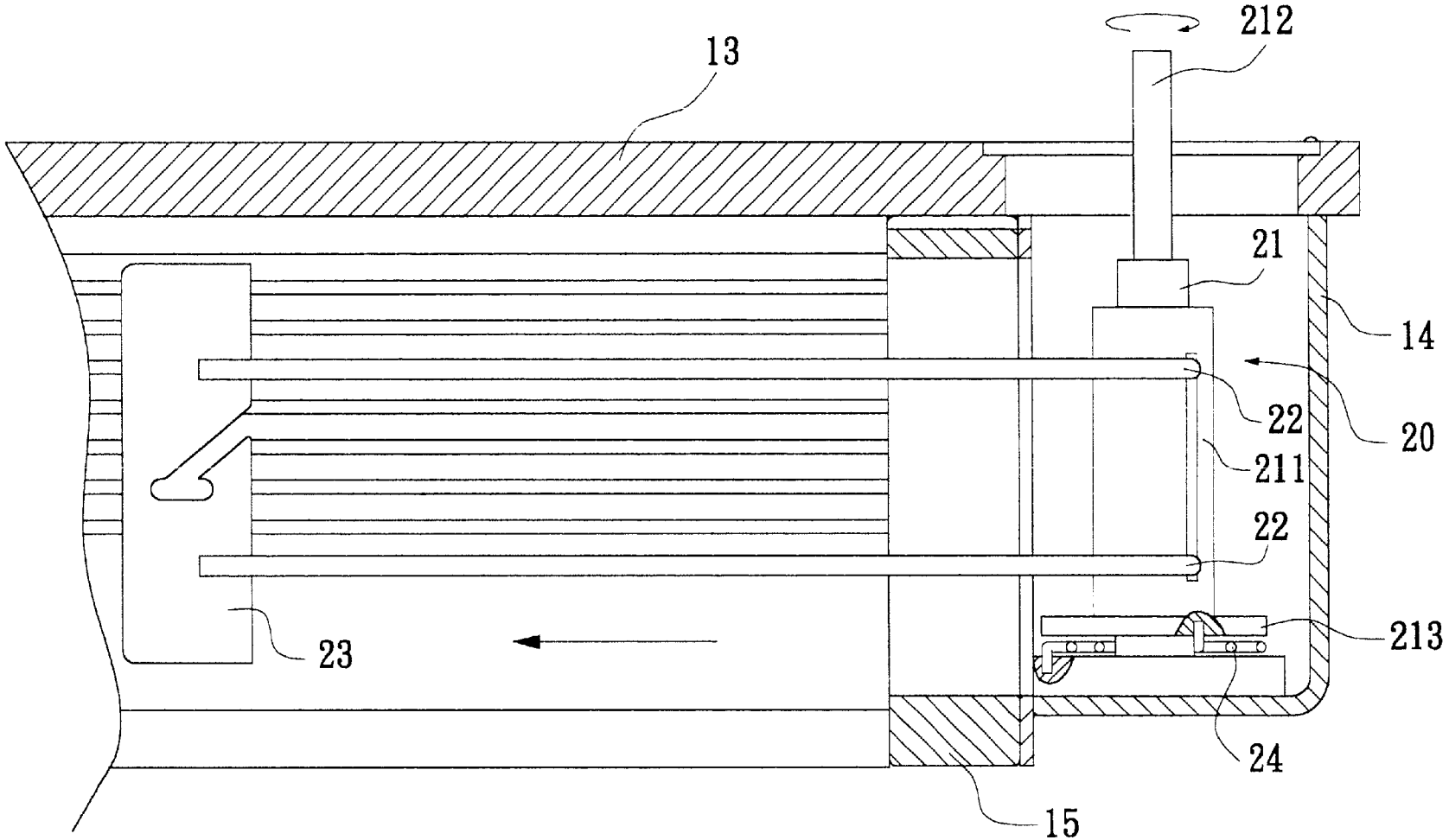
FIG. 3 is a sectional view according to FIG. 2, showing the nailing operation of the present invention.

Please refer to FIGS. 1 to 3. The nail-pushing structure of the nailing gun of the present invention includes a gun body 10 having a handle section 11 and a head section 12. A frame body 13 downward extends from the head section 12. The bottom of the frame body 13 is formed with a receptacle 14 on which a nail-pushing plate seat 15 is mounted. A nail magazine 30 is disposed between the nail-pushing plate seat 15 and the head section 12. The nail magazine 30 has a nail channel (not shown) in which a row of nails 31 are loaded.

A nail-pushing structure 20 is pivotally mounted in the receptacle 14 by a shaft 21. The shaft 21 has a large diameter section 211 and a small diameter section 212. Two flexible members 22 are fixedly disposed on the large diameter section 211. In this embodiment, the flexible members 22 are steel cords. The opposite ends of the flexible members 22 extend out of the nail-pushing plate seat 15 to connect with a nail-pushing plate 23 positioned in the nail channel.

The bottom edge of the large diameter section 211 is formed with a flange 213. A coiled spring 24 is placed between the flange 213 and the inner bottom face of the receptacle 14. One end of the coiled spring 24 is fixed on the flange 213, while the other end thereof is fixed on inner bottom face of the receptacle 14 to provide a twisting force.

When a user desires to install the nail magazine 30 loaded with a row of nails 31, by means of cranking a crank 40 fitted on the small diameter section 212 of the shaft 21, the flexible members 22 disposed on the large diameter section 211 are wound on the large diameter section 211. At this time, the nail-pushing plate 23 is retracted into the nail-pushing plate seat 15 along the nail channel. Under such circumstance, the nail magazine 30 can be installed from one side of the frame body 13 and the nail-pushing plate 23 can push the bottom-most nail 31 in the nail magazine 30 along the nail channel.

Figure 4:
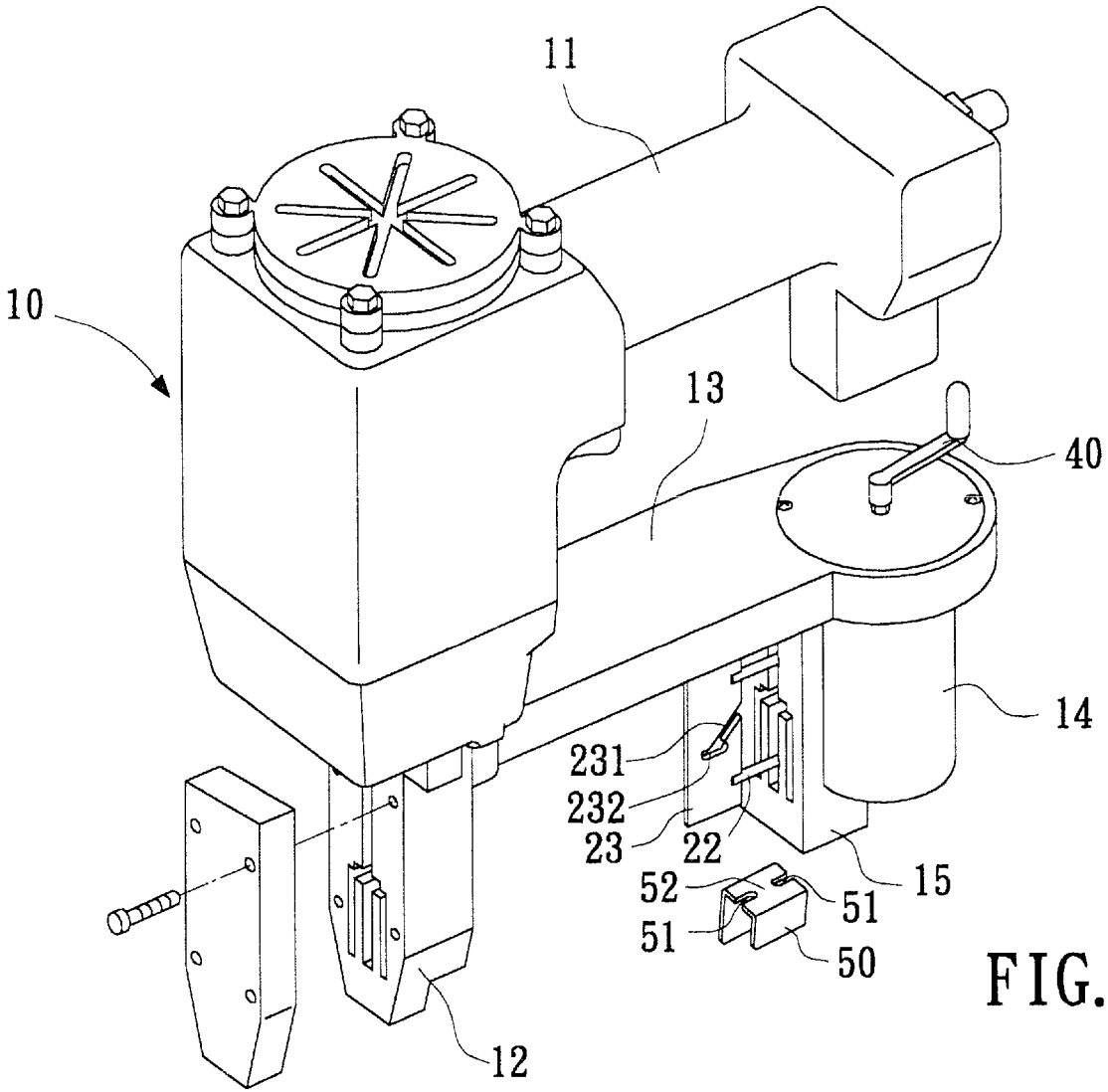
FIG. 4 is a perspective exploded view of another embodiment of the present invention.
Figure 5:
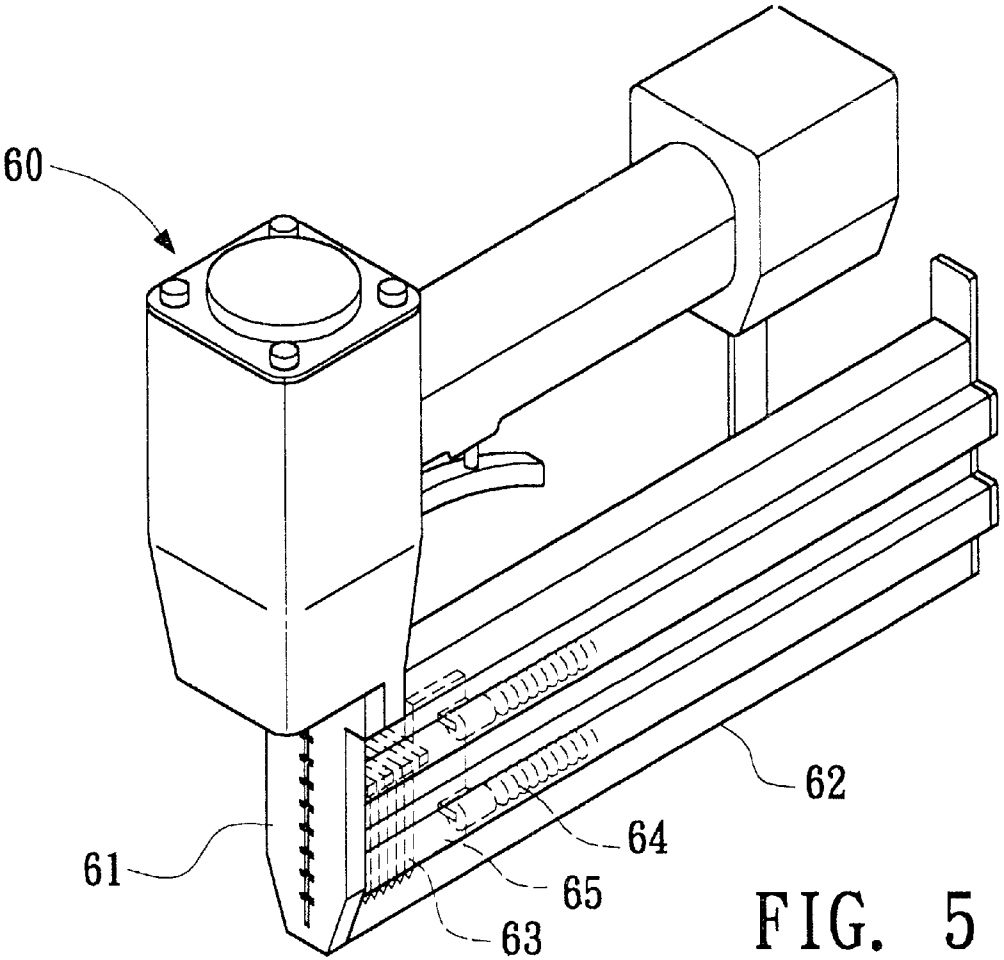
FIG. 5 PRIOR ART
FIG. 5 is a perspective view of a conventional nailing gun.

In use of the present invention, as shown in FIG. 3, the nail-pushing plate 23 is able to continuously push the row of nails 31 in the nail magazine 30 into the head section 12 for nailing operation. In the nailing operation, the number of the row of nails 31 in the nail magazine 30 is gradually reduced. The coiled spring 24 of the nail-pushing structure 20 provides a resilient restoring force so that the flexible members 22 disposed on the large diameter section 212 continuously outward push the nail-pushing plate 23. Accordingly, the nail-pushing plate 23 can truly push the row of nails 31 in the nail magazine 30 into the head section 12 of the gun body 10 for nailing operation The above structure is applied to nailing operation of T-shaped nails 31. An accessory can be added to the present invention, enabling the present invention to push other nails with different patterns. Referring to FIG. 4, the nail-pushing plate 23 is formed with an oblique slot 231 inward extending from one side of the nail-pushing plate 23. The oblique slot 231 includes a straight insertion slot 232 at the middle section of the nail-pushing plate 23. A U-shaped bent plate 50 is inserted in the insertion slot 232. Two sides of the bent plate 50 are respectively formed with two notches 51 defining therebetween a connecting section 52. The notches 51 of the bent plate 50 are inserted in the oblique slot 231 of the nail-pushing plate 23 and the bent plate 50 is finally pushed into the insertion slot 232 with the connecting section 52 totally restricted in the insertion slot 232. At this time, the bent plate 50 is normal to the nail-pushing plate 23 for pushing a row of U-shaped nails 31. Accordingly, the present invention is applicable to different patterns of nails and the replacement is very easy.

According to the above arrangement, the present invention has the following advantages:

1. It is easy to load the row of nails. When a user desires to install the nail magazine loaded with a new row of nails, by means of cranking a crank fitted on the small diameter section of the shaft, the flexible members disposed on the large diameter section are wound on the large diameter section. At this time, the nail-pushing plate is retracted into the nail-pushing plate seat along the nail channel. Under such circumstance, the nail magazine can be installed from one side of the frame body.
2. The present invention is applicable to different patterns of nails. The nailing-pushing plate is able to push T-shaped nails. When the U-shaped bent plate is additionally inserted in the nail-pushing plate, the nail-pushing plate also serves to push U-shaped nails. The replacement of the nail-pushing plate is easy to perform.

The above embodiments are only used to illustrate the present invention, not intended to limit the scope thereof. Many modifications of the above embodiments can be made without departing from the spirit of the present invention.

What is claimed is:

1. A nail-pushing structure of nailing gun, comprising:

a gun body having a handle section and a head section, a frame body downward extending from the head section, a bottom of the frame body being formed with a receptacle on which a nail-pushing plate seat is mounted, a nail magazine being disposed between the nail-pushing plate seat and the head section, the nail magazine having a nail channel in which a row of nails are loadable; and a nail-pushing structure pivotally mounted in the receptacle by a shaft, the shaft having a large diameter section and a small diameter section, flexible members being fixedly disposed on the large diameter section, opposite ends of the flexible members extending out of the nail-pushing plate seat to connect with a nail-pushing plate positioned in the nail channel.

2. The nail-pushing structure of nailing gun as claimed in claim 1, wherein the flexible members are steel cords.

3. The nail-pushing structure of nailing gun as claimed in claim 1, wherein bottom edge of the large diameter section of the shaft is formed with a flange, a coiled spring being placed between the flange and inner bottom face of the receptacle, one end of the coiled spring being fixed on the flange, while the other end thereof being fixed on inner bottom face of the receptacle to provide a twisting force.

4. The nail-pushing structure of nailing gun as claimed in claim 1, wherein a U-shaped bent plate is inserted in the nail-pushing plate for pushing U-shaped nails.

5. The nail-pushing structure of nailing gun as claimed in claim 4, wherein the nail-pushing plate is formed with an oblique slot inward extending from one side of the nail-pushing plate, the oblique slot including a straight insertion slot at a middle section of the nail-pushing plate, a U-shaped bent plate being inserted in the insertion slot, two sides of the bent plate being respectively formed with two notches defining therebetween a connecting section, the notches of the bent plate being inserted in the oblique slot of the nail-pushing plate and the bent plate being finally pushed into the insertion slot with the connecting section totally restricted in the insertion slot.

* * * * *